US005885064A

United States Patent [19]

McCoy

[11] Patent Number: 5,885,064

[45] Date of Patent: Mar. 23, 1999

[54] COMPRESSOR VALVE ASSEMBLY WITH IMPROVED FLOW EFFICIENCY

[75] Inventor: Amy Lynn McCoy, Newfane, N.Y.

[73] Assignee: General Motors Corporation, Detroit, Mich.

[21] Appl. No.: 885,969

[22] Filed: Jun. 30, 1997

[51] Int. Cl.[6] ..... F04B 53/10

[52] U.S. Cl. ..... 417/569; 417/571; 137/855

[58] Field of Search ..... 417/269, 569, 417/571; 137/855

[56] References Cited

U.S. PATENT DOCUMENTS

| | | | |
|---|---|---|---|
| 4,257,457 | 3/1981 | Namura et al. . | |
| 4,642,037 | 2/1987 | Fritchman | 137/855 |
| 4,764,091 | 8/1988 | Ikeda et al. . | |
| 4,778,360 | 10/1988 | Ikeda et al. . | |
| 4,781,540 | 11/1988 | Ikeda et al. . | |
| 4,976,284 | 12/1990 | Hovarter . | |
| 5,173,040 | 12/1992 | Yamazawa et al. . | |
| 5,197,867 | 3/1993 | Kandpal | 137/855 |
| 5,226,796 | 7/1993 | Okamoto et al. | 417/571 |
| 5,672,053 | 9/1997 | Sabna | 417/569 |

FOREIGN PATENT DOCUMENTS

| | | | |
|---|---|---|---|
| 63-113779 | 7/1988 | Japan | 137/855 |

*Primary Examiner*—Timothy S. Thorpe
*Assistant Examiner*—Cheryl J. Tyler
*Attorney, Agent, or Firm*—Patrick M. Griffin

[57] ABSTRACT

An improved reed type compressor discharge valve assembly uses a conventional reed and reed stop, but increases flow efficiency past the reed with a uniquely configured valve plate port. The valve plate port has an elongated ovoid or teardrop shape, oriented colinear to and symmetrical to the reed. A greater surface area is thus opened to the underside of the reed, compared to a round port, and the wider end of the port is located beneath the higher lifting free end of the reed, providing for a larger, more efficient flow path.

3 Claims, 3 Drawing Sheets

COMPRESSOR VALVE ASSEMBLY WITH IMPROVED FLOW EFFICIENCY

TECHNICAL FIELD

This invention relates to automotive air conditioner compressors in general, and specifically to a discharge valve for such a compressor with a non circular valve port having a novel orientation relative to the reed valve.

BACKGROUND OF THE INVENTION

Automotive air conditioning compressors are typically piston machines, in which reciprocating pistons within cylinder bores pull in refrigerant from a low pressure cavity on the back stroke, and drive it out to a high pressure discharge cavity on the up stroke. Reverse flow into the cylinder bores from the discharge cavity is prevented by one way discharge valves. Most often, the discharge valve uses a thin, resilient, elongated reed that is either riveted to the flat surface of a thicker, disk-shaped valve plate, or which is lanced integrally out of a thin metal sheet that is sandwiched to the surface of the valve plate. The valve plate separates the cylinder bores from the various refrigerant cavities. The front of the reed covers a refrigerant port through the plate, while the back end of the reed acts as a hinge. The reed bends up about the hinge, away from the surface of the plate, to allow flow across the port in only the desired direction, and snaps back down against the valve plate to prevent reverse flow. In this way, the assembly of reed and valve plate maintains the desired pressure differentials in a simple, passively responsive fashion.

While simple, the typical reed valve assembly does have some inherent limitations. Since the metal reed snaps up and down against the metal valve plate, it can cause noise. The reed also requires a metal stop to limit its upward bending, contact with which can cause noise. Since the reed bends with every piston stroke, it is stressed accordingly, to a degree that roughly corresponds to the height that it lifts from the surface of the valve plate while opening. The reed lift height must be great enough that flow across the port, which must pass around the sides of the reed, is not limited. In order to create enough reed lift height away from the valve plate, a minimal reed length is necessary, since a short reed will be inherently stiff. Moreover, the lift height varies along the length of the reed, being greatest at the front end, and less toward the back. Since the port has a finite diameter, the reed does not lift away from the port by a constant height, and flow will be more restricted through that area of the port that is closest to the hinge point. This requires that the lift height at the front of the reed be greater than it would have to be if the reed lifted away from the plate uniformly. And, again, greater reed lift height is also associated with noise and reed stress. If flow is too limited by the valve, especially in the case of a discharge valve, an excessive so called overshoot pressure can occur, meaning the degree to which pressure in front of the piston exceeds the elevated pressure created in the compressor discharge cavity. Overshoot pressure is a good measure of excess, wasted work done by the compressor, and is also the cause of compressor vibration, shaking and noise, which can be a greater problem than inherent reed noise.

Reed valves of the type described may also be used as suction valves, that is, the valves which open on piston back stroke so as to allow low pressure refrigerant vapor to enter the cylinder bore, to then be compressed on the forward stroke. Suction valve reeds do not have metal stop members, however, since the piston head generally comes too close to the back surface of the plate. However, the suction valve may also be a disk shaped, thin metal piece carried on and with the front end of the piston itself, rather than an elongated reed.

Every valve must have a port to be covered and uncovered by the reed, of course, and these are typically round only, because of the obvious ease with which a round hold can be drilled or simply punched through. Non round or circular ports are disclosed in existing prior art patents, however, although not generally found in production compressors. At least one patent, U.S. Pat. No. 4,257,457 issued Mar. 24, 1981 shows a non circular valve port that is elongated with an apparently constant width, with what might be referred to as a "stadium" rather than an ovoid shape. The port is also covered by a unique reed that is axially slidable up and down at both ends, rather than bending up about a single hinge point.

The prior art also shows non circular valve ports with an ovoid or trapezoidal shape, that is, wider at one end than at the other. However, the known prior discloses the narrower end of the port at or near the unconfined free end of the reed, where the opening or "lift" height is greater, not vice versa. For example, U.S. Pat. No. 4,781,540 issued Nov. 1, 1988 to Ikeda, et al. shows, in one embodiment, an ovoid port so oriented, with the narrower end at the free end of the reed. However, there appears to be no discussion of that aspect of the port shape or its orientation, and the real point of the invention is to situate the port, be it circular or non circular, asymmetrically relative to the axis reed. The same patent also discloses non circular port shapes other than ovoid, including kidney shapes. The stated objective of the patent is to cause the reed to open and close with a sideways bend, rather than flat to the plate, so as to prevent the development of oscillatory vibrations in the reed.

Another non circular port shape, disclosed in U.S. Pat. No. 4,778,360, issued Oct. 18, 1988 to Ikeda et al. is essentially the polygonal equivalent of an ovoid, that is, trapezoidal, and the patent is very definite in orienting the narrow end of the port at the free, higher lift end of the reed. It is claimed that placing the wider end of the port beneath the lower lifting main body of the reed, and the narrower end of the port beneath the higher lifting free end of the reed, will yield a more constant flow rate and pressure. That is, where the reed lift is lower, the port is wider, and vice versa. Since this patent has the same assignee and lead inventor as the '540 patent described just above, it is logical to assume that the same philosophy was behind the identical orientation of the ovoid ports there, although that particular claimed advantage was not articulated.

While not prior art per se, co assigned and co pending U.S. patent application U.S. Ser. No. 08/416,123, allowed Aug. 29, 1995 now U.S. Pat. No. 5,672,053, a compressor reed valve with a circular port was disclosed, but with an elongated, recessed channel behind and opening into the port. While the channel itself is itself substantially straight and constant in width, it blends into the circular port with rounded edges which give the circular port and channel together a somewhat elliptical outline, with the wider end of the outline near and beneath the free end of the port. However, the port itself, which is the only part of the outline that actually pierces through the plate, is disclosed as circular only, with no explicit teaching that it be anything but circular or round.

SUMMARY OF THE INVENTION

The invention provides a reed valve in which a non circular, ovoid shaped port is oriented in the opposite direction to those disclosed above, with the wider end near the high lift, free end of the reed. Consequently, relative to a conventional round port with a diameter comparable to the wider end of the port, more area is available for the pressure developed in front of the piston to act on and lift the reed away from the valve plate. Relatively more gas flow path and area is also available to discharge the developed pressure into the discharge cavity. The wider end of the port is situated where it can have more effect, that is, where the higher reed lift allows for a potentially greater flow path. Piston overshoot pressure is reduced compared to a comparable round port.

BRIEF DESCRIPTION OF THE DRAWINGS

These and other features of the invention will appear from the following written description, and from the drawings, in which.

DESCRIPTION OF THE PREFERRED EMBODIMENT

Figure 1:
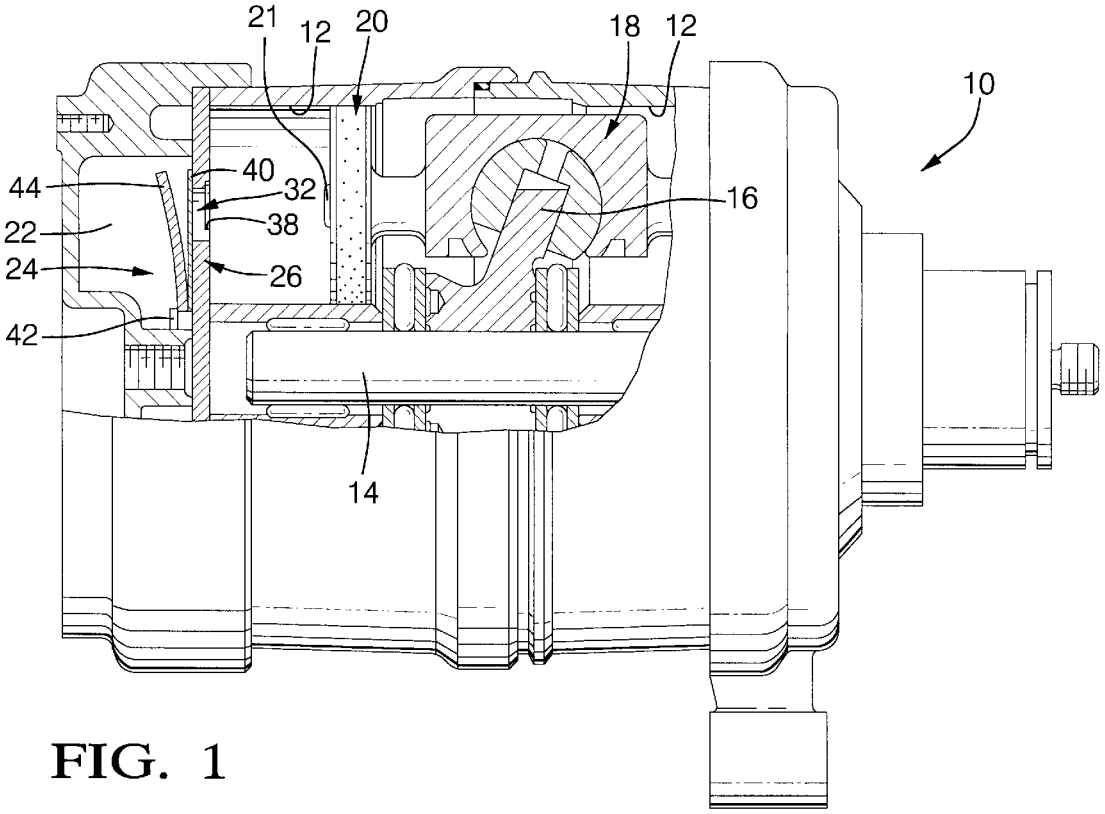
FIG. 1 is a compressor partially sectioned to show one cylinder bore and one discharge valve assembly in a closed position.

Referring first to FIG. 1, an automotive air conditioning system compressor, indicated generally at 10, has a plurality of evenly spaced cylinder bores 12 surrounding a central drive shaft 14. A swashplate 16 reciprocates a series of three two headed pistons, indicated generally at 18, each of which has one head 20 movable within a respective bore 12. Each piston 18 sequentially draws in low pressure refrigerant and expels it under pressure. A suitable suction valve, not illustrated in detail, admits low pressure refrigerant to the cylinder bore 12, in front of piston head 20, when piston 18 is in the retracted position shown. In the compressor 10 disclosed, the suction valve is the small disk type that is affixed directly to the piston head 20 with a central rivet 21, and which draws low pressure refrigerant in from behind the piston 18 on the backstroke. On the upstroke, piston head 20 compresses and drives the refrigerant in bore 12 into a high pressure discharge cavity 22, from which it eventually is sent to a condenser. Separating the discharge cavity 22 from each cylinder bore 12, and maintaining the pressure differential between them by preventing reverse flow, is the valve assembly of the invention, indicated generally at 24.

Figure 2:
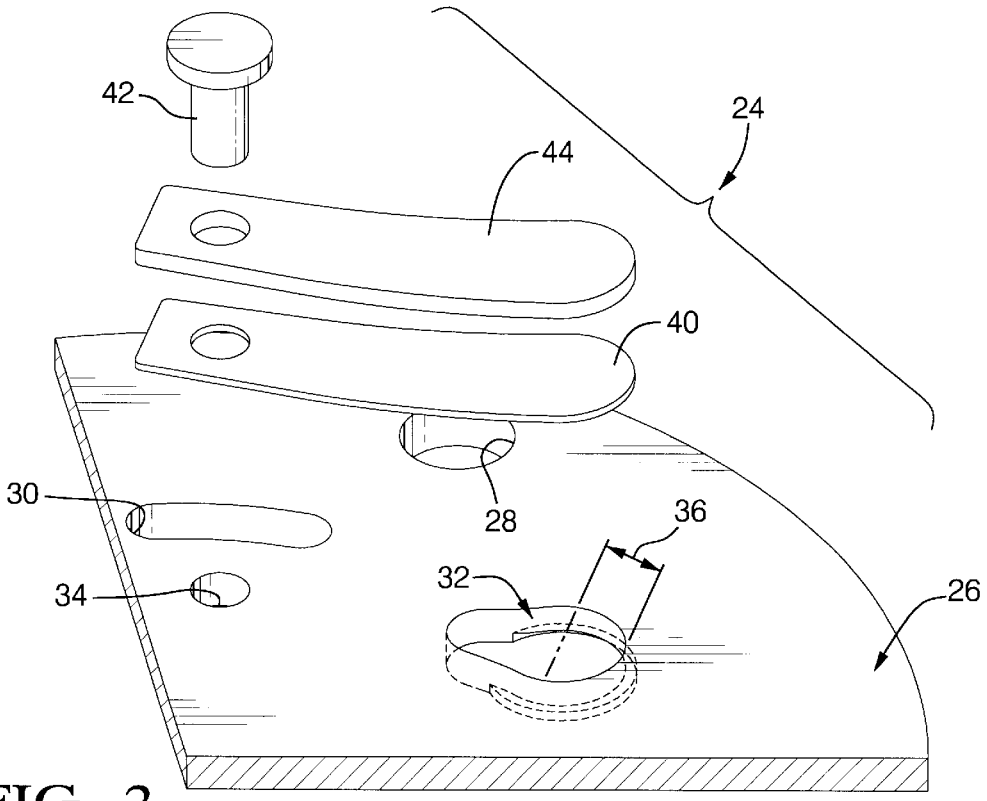
FIG. 2 is a perspective view of the valve plate with the reed and stop disassembled.
Figure 3:
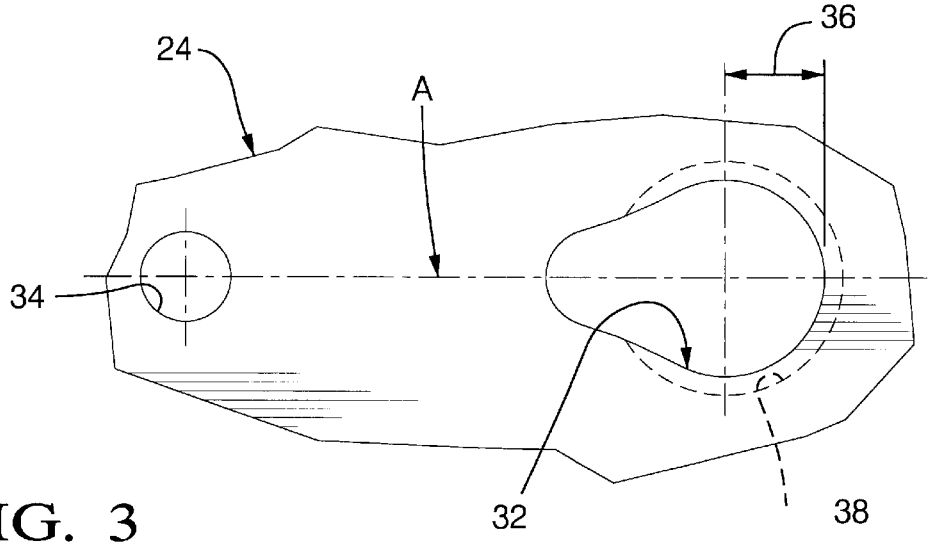
FIG. 3 is a plan view of the valve plate and port alone.
Figure 5:
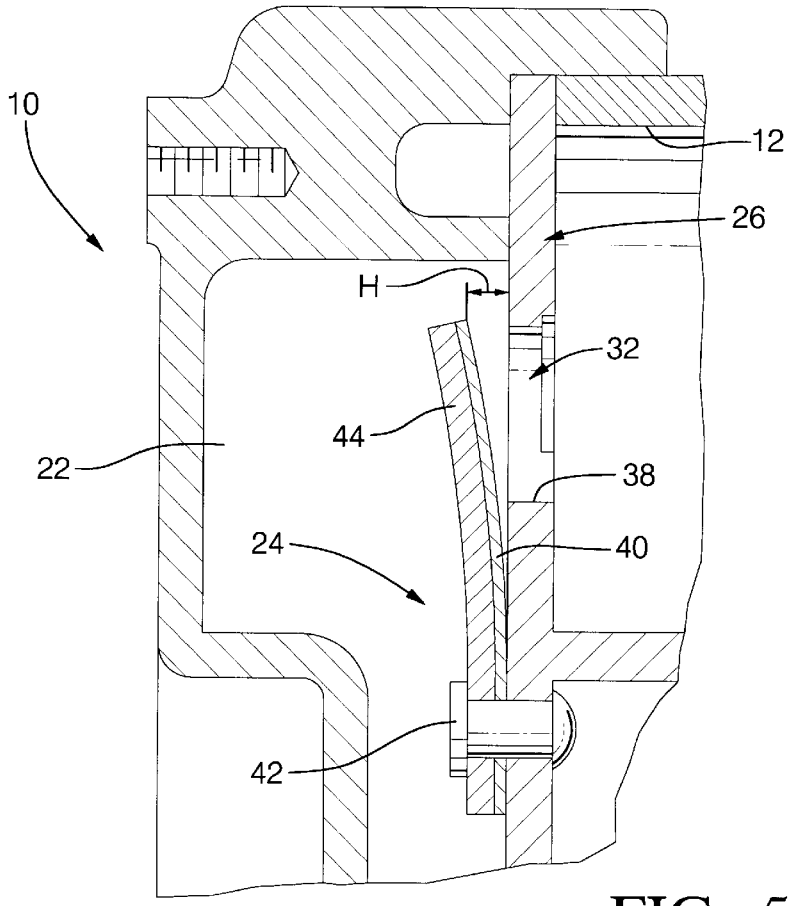
FIG. 5 is an enlargement of that portion of FIG. 1 showing the reed valve and port, in an open position.

Referring next to FIGS. 2, 3 and 5, the foundation of valve assembly 24 is a disk-shaped valve plate 26. A valve plate like 26 would be placed in front of the other side of the pistons 18, and so need not be separately described. Valve plate 26 is a robust steel plate, approximately 3 mm thick, almost as large in diameter as the compressor 10 itself, and machined smooth and flat on both sides. Several voids and holes in plate 26 serve various functions. Six simple round holes 28 provide clearance for non-illustrated bolts, which clamp the various components of compressor 10 together. Two oblong slots 30 provide discharge cross over passages which form part of the complex internal refrigerant gas circuit typical of compressor designs incorporating two headed pistons. Most significant to the invention, three evenly spaced ovoid or tear drop shaped discharge ports, indicated generally at 32, are cut through plate 26. Each port 32 is spaced from a round rivet hole 34. The wider forward end of each ovoid port 32, indicated at 36, is basically a semicircular section, the center point of which, indicated by the crossed dotted lines in FIG. 3, is aligned with the similarly indicated center of a respective rivet hole 34, thereby defining an axis A relative to which the entire port 32 is symmetrical. The opposite flat surface of plate 26 is chamfered at 38 to a slight depth, concentric to the wide port end 36, so as to provide clearance for the piston rivet 21.

Referring next to FIGS. 1 and 2, the other components of valve assembly 24 are a reed 40, rivet 42, and reed stop 44, one set for each port 32. Each reed 40 is a thin spring steel member, long enough to extend from a rivet hole 34 far enough to cover port 32. Reed 40 has a basically constant width, which is slightly greater than the port wider end 36, but is rounded off at the very end. The length of reed 40 is basically colinear to the axis A defmed above. The back end of each reed 40 is fixed firmly by rivet 42 through a rivet hole 34 so as to generally overlay and cover the entire port 32, symmetrical as well as colinear thereto. Specifically, the wider end 36 of port 32 sits substantially directly below the free end of reed 40, while the narrower back end of port 32 is farther inboard. Rivet 42 provides the hinge point about which reed 40 bends. Reed stop 44, which is sandwiched above reed 40 by the same rivet 42, sits permanently above reed 40. Reed 40 itself is flat in a free, unstressed state, and lies flush to the surface of plate 26 in its closed condition, as shown in FIG. 1. If desired, the perimeter of port 32 could be surrounded by a shallow groove or trough, matching the outline of port 32, to provide for a quieter closing of the reed 40 against the surface of plate 26.

Figure 4:
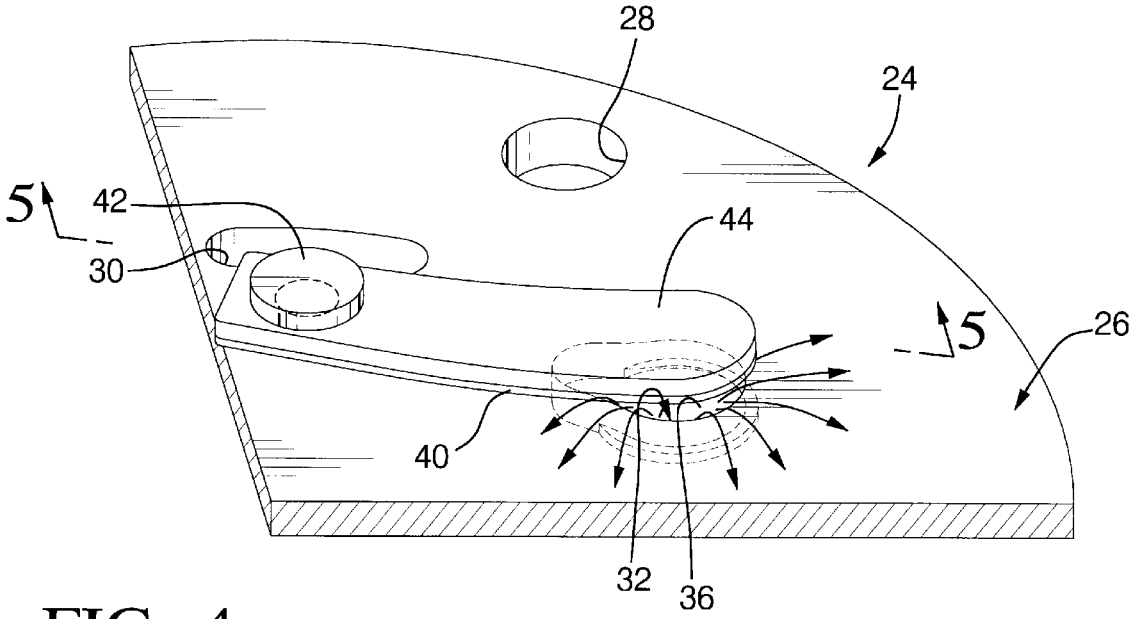
FIG. 4 is a view like FIG. 2, but showing the reed and stop attached to the plate, and in an open position.

Referring next to FIGS. 1, 4 and 5, the operation of valve assembly 24 is illustrated. Plate 26 is clamped into compressor 10 when it is bolted together, separating the cylinder bores 12 from the discharge cavity 22, oriented so that a port 32 is aligned with each cylinder bore 12. Reed 40 is located on the high pressure side of plate 26. On the backstroke of piston 18, the high pressure refrigerant in discharge cavity 22 cannot reverse flow into the cylinder bore 12, because the free state condition of reed 40 is flat to the surface of plate 26, covering and blocking port 32, a condition that is assisted by the high pressure in cavity 22. Low pressure refrigerant would flow in, however. On the upstroke, as seen in FIGS. 4 and 5, reed 40 is pushed outwardly, and its bending up and away from the surface of valve plate 26 about the rivet 42 in cantilever fashion, that is, to a height H that progressively increases moving outboard along the reed 40 and toward its free end. The height and angle of reed opening is limited to whatever level is desired by the stop 44. Given the lengthened (along axis A) shape of port 32, it presents more surface area to the undersurface of reed 40 than would a conventional round port of a diameter comparable to the port wide end 36, creating more opening force for, and a consequently quicker opening of, reed 40. Refrigerant is expelled forcefully through the port 32, which is smaller in size than the cylinder bore 12, causing the expelled gas to be highly pressurized by the rapidly moving piston head 20. As shown by the flow arrows in FIG. 4, the greater area of port 32 provides a larger, more open, flow path for compressed discharge refrigerant, which can flow with reduced resistance through the greater length of port 32, around the sides of reed 40 and into cavity 22. The front end of reed 40 lifts to the greatest height, and the wider port end 36 which it overlays is therefore ideally oriented and located to take advantage of the greater available flow path at the reed front end. This may be contrasted with an oppositely oriented ovoid port, in which the narrower port end would actually limit and restrict the available gas flow at the very point where it could potentially be the greatest. Along the axis of port 32, moving inboard and toward the rivet hole 34, the lift height of the reed 40 and the potential space for gas flow steadily decreases, but the narrower end of the effectively elongated port 32 still provides more gas flow path than would be available with a conventional round port or oppositely directed ovoid port.

Figure 6:
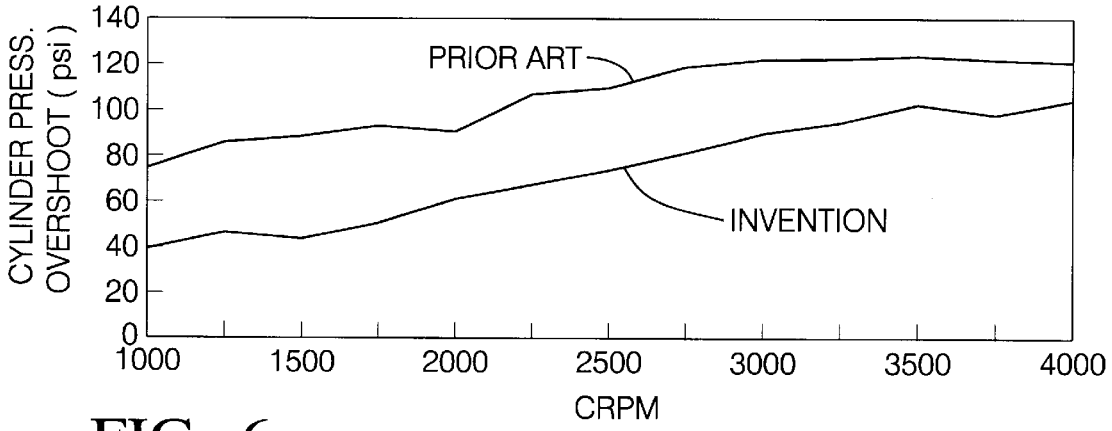
FIG. 6 is a graph comparing the overshoot pressures of valve assemblies made according to the invention and the prior art.

As shown in FIG. 6, the more efficient outflow allowed by the invention leads to a significantly lower overshoot pressure across a wide compressor speed range, as compared to a prior art port of round, circular shape. Again, overshoot pressure is the degree to which pressure within the cylinder bore 12 exceeds the pressure in the discharge cavity 22, and represents wasted compressor work. Overshoot pressure manifests itself in vibration and noise, which is also significantly reduced for the valve assembly 24 of the invention. With the invention, lower overshoot is obtained both by virtue of quicker reed lift and greater available flow path, both of which features arise from the shape, and specific orientation of, the elongated, teardrop shaped port 32. In addition, one could obtain a prior art level of overshoot pressure with a narrower port 32 and reed 40, or with a reed 40 that lifted to a lesser height, both of which would serve to reduce noise and reed stress.

The increased efficiency of the valve assembly 24 of the invention is achieved at low cost, given the fact that the reed 40 and stop 44 are essentially unchanged. The port 32 could not be drilled in one step, as a round port could, but could be punched or pierced in one step by a punch of corresponding shape. Again, the same feature could be incorporated in a suction reed valve, if desired. Other specific port shapes could provide the same basic advantage, if they had the same basic shape and orientation as port 32, that is, elongated colinearly with and symmetrical to the length of the reed 40. For example, a trapezoidal shaped port like that shown in U.S. Pat. No. 4,778,360 described above, but oriented oppositely to the port disclosed there, could provide the same basic advantage or higher flow rate. However, it is thought that a port of that shape, with sharper corners, would be somewhat noisier and less flow efficient than the teardrop shaped port 32 disclosed here. Therefore, it will be understood that it is not intended to limit the invention to just the embodiment disclosed.

I claim:

1. In a refrigerant compressor having a piston and cylinder bore separated from a refrigerant cavity by a valve plate having a port therethrough and with a pressure differential existing across said valve plate, and in which reverse flow across said port is prevented by an elongated, cantilevered reed having a back end and a free end located on the cavity side of said valve plate that passively opens and closes said port by bending away from a surface of said valve plate about a hinge point located at said reed back end to a height that increases moving toward said reed free end, the improvement comprising, said port having a non circular shape extending uniformly all the way through said valve plate, generally elongated colinearly with said reed and symmetrically disposed relative to said reed, said port having a wider front end located substantially beneath said reed free end and a narrower back end located inboard of said reed free end, whereby increased surface area is presented to the underside of said reed, a greater flow path area is provided through said valve plate, and the wider portion of said port is located nearer to the free end of said reed, thereby creating a more efficient flow through said port.

2. A refrigerant compressor according to claim 1 in which said refrigerant cavity is a discharge cavity.

3. A refrigerant compressor according to claim 1 in which the wider end of said port is substantially a section of a circle.

* * * * *